US009196991B2

(12) United States Patent
Liu

(10) Patent No.: US 9,196,991 B2
(45) Date of Patent: Nov. 24, 2015

(54) CONDUCTING DEVICE AND SOCKET

(71) Applicant: Jie Liu, Zhuhai (CN)

(72) Inventor: Jie Liu, Zhuhai (CN)

( * ) Notice: Subject to any disclaimer, the term of this patent is extended or adjusted under 35 U.S.C. 154(b) by 0 days.

(21) Appl. No.: 14/396,746

(22) PCT Filed: Apr. 1, 2013

(86) PCT No.: PCT/CN2013/000376
§ 371 (c)(1),
(2) Date: Oct. 24, 2014

(87) PCT Pub. No.: WO2013/163886
PCT Pub. Date: Nov. 7, 2013

(65) Prior Publication Data

US 2015/0104982 A1 Apr. 16, 2015

(30) Foreign Application Priority Data

May 3, 2012 (CN) ..... 2012 1 0132719

(51) Int. Cl.
*H01R 13/44* (2006.01)
*H01R 13/187* (2006.01)
*H01R 13/11* (2006.01)
*H01R 13/18* (2006.01)

(52) U.S. Cl.
CPC ..... *H01R 13/187* (2013.01); *H01R 13/11* (2013.01); *H01R 13/112* (2013.01); *H01R 13/18* (2013.01)

(58) Field of Classification Search
CPC ..... H01R 13/4538; H01R 103/00
USPC ..... 439/140, 188, 346; 200/51.09
See application file for complete search history.

(56) References Cited

U.S. PATENT DOCUMENTS

| | | | | |
|---|---|---|---|---|
| 4,227,596 | A | 10/1980 | Bartels | |
| 5,277,602 | A * | 1/1994 | Yi | 439/138 |
| 5,791,931 | A | 8/1998 | Burkhart, Sr. | |
| 6,332,781 | B1 | 12/2001 | Ito | |

FOREIGN PATENT DOCUMENTS

| | | | |
|---|---|---|---|
| CN | 2224467 | Y | 4/1996 |
| CN | 1269619 | A | 10/2000 |
| CN | 2850028 | Y | 12/2006 |
| CN | 201213166 | Y | 3/2009 |
| CN | 202523883 | U | 11/2011 |
| CN | 102637969 | A | 8/2012 |
| TW | 200401899 | A | 2/2004 |

* cited by examiner

*Primary Examiner* — Phuongchi T Nguyen
(74) *Attorney, Agent, or Firm* — Gokalp Bayramoglu

(57) ABSTRACT

The conducting device and the socket with stable electrical-connection ability are provided. The socket comprises a socket body, the conducting device arranged in an accommodating slot of the socket body, and an ending cap arranged on the socket body. The conducting device comprises a movable spring plate, a stationary spring plate and a reset spring member. The movable spring plate is rotatably connected with the stationary spring plate. The reset spring member is located in the outer side of the movable spring plate and contacts with the movable spring plate. An inserting slot is formed between the movable spring plate and the stationary spring plate. The width of the inserting slot is gradually decreased from inner part to outer part. The ending cap blocks the reset spring member and is adaptive with the socket body.

5 Claims, 3 Drawing Sheets

CONDUCTING DEVICE AND SOCKET

FIELD OF THE INVENTION

The present invention relates to a conducting device and a socket.

BACKGROUND OF THE INVENTION

Currently, socket and plug are used for electrical connecting on machinery. Plug is provided with conductive column, and socket is provided with conductive elastic plate which connects with the conductive column. It is easy for the connect part of conductive elastic plate with curving annular in shape to be deformed and become loose after frequent plugging ins and outs, which leads to bad contact and poor electric stability.

SUMMARY OF THE INVENTION

The objective of the present invention is to provide a conducting device and a socket with stable electrical-connection ability.

A conducting device comprises a movable spring plate, a stationary spring plate and a reset spring member. The movable spring plate is installed on the stationary spring plate and rotatably connected with the stationary spring plate. The reset spring member is located in the outer side of the movable spring plate and contacts with the movable spring plate. An inserting slot is formed between the movable spring plate and the stationary spring plate, and the width of the inserting slot is gradually decreased from inner part to outer part.

The reset spring member is cylinder spring, leaf spring, torsional spring or elastic rubber article, and the reset spring member is provided transversely and located in the outer side of the movable spring plate rotating direction.

The lower end of the movable spring plate is rotatably connected with the lower end of the stationary spring plate, and both upper ends of the movable spring plate and stationary spring plate comprise at least one arc-shape bending section.

A socket comprises the conducting device described above, a socket body and an ending cap arranged on the socket body. The conducting device is arranged in an accommodating groove of the socket body. The ending cap blocks the reset spring member and is adaptive with the socket body, and an abdicating groove is arranged on the ending cap for providing space in which the movable spring plate is capable of rotating.

The conducting device of presented invention comprises a movable spring plate, a stationary spring plate and a reset spring member. The movable spring plate is installed on the stationary spring plate and rotatably connected with the stationary spring plate. The reset spring member is located in the outer side of the movable spring plate and contacts with the movable spring plate. An inserting slot is formed between the movable spring plate and the stationary spring plate, and the width of the inserting slot is gradually decreased from inner part to outer part. The movable spring plate resists the elastic force of the reset spring member and rotates relatively to the stationary spring plate when inserting a plug into the inserting slot, then the movable spring plate returns to original position and contacts the plug closely under the action of elastic force. The connection is stable and bad connection does not occur unless the structure is destroyed or burnt down. Therefore, the conducting device and socket of present invention are provided with high electrical connecting stability.

DETAILED DESCRIPTION OF THE INVENTION

Embodiment 1

Figure 1:
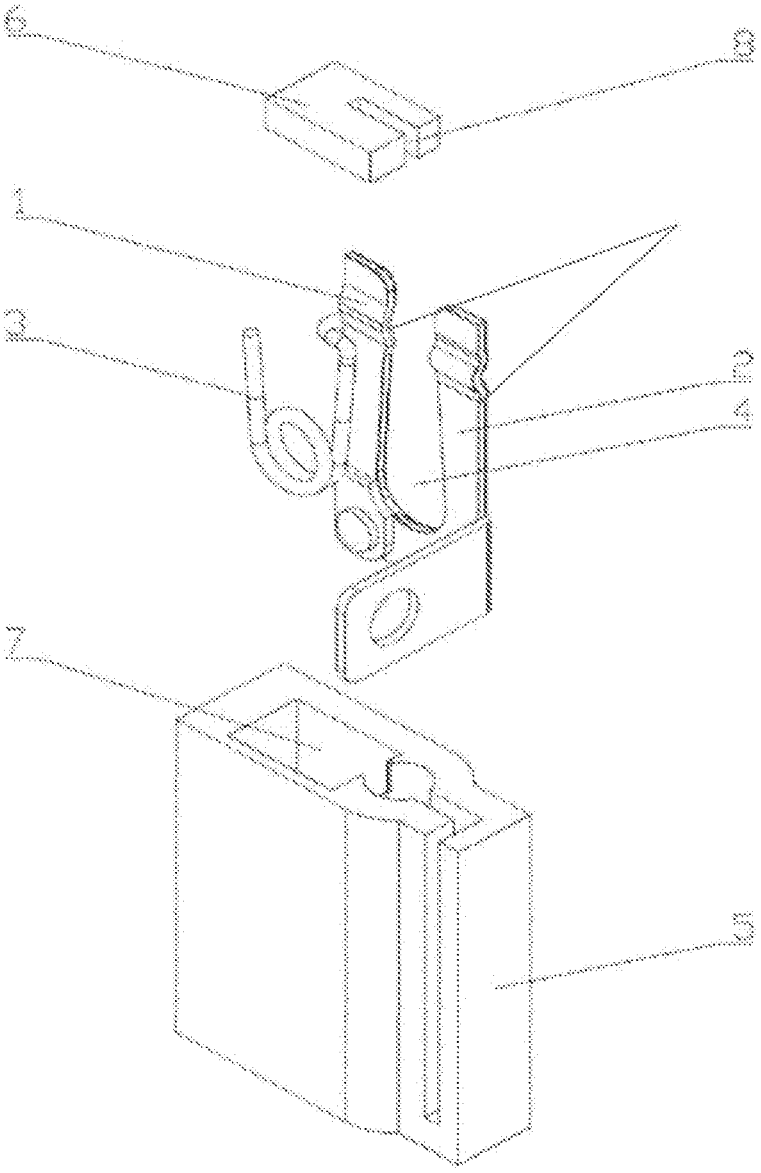
FIG. 1 illustrates a schematic view of the first embodiment of the present invention.

Referring to FIG. 1, a conducting device of this embodiment is applied on a socket. The socket comprises the conducting device, a socket body 5 and an ending cap 6. Socket body 5 is hollow with an accommodating groove 7 configured in the middle. The conducting device is arranged in accommodating groove 7. The conducting device comprises a movable spring plate 1, a stationary spring plate 2 and a reset spring member 3. Movable spring plate 1 is installed on the stationary spring plate 2 and rotatably connected with stationary spring plate 2. More specifically, the lower end of movable spring plate 1 is rotatably connected with the lower end of stationary spring plate 2 by dowel. The reset spring member 3 is located in the outer side of rotating direction of movable spring plate 1 and contacts with movable spring plate 1. Reset spring member 3 is a torsional spring on which a limiting slot contacting with sidewall of movable spring plate 1 is configured. Reset spring member 3 forces movable spring plate 1 to return to original position and contact closely with conductive column of a plug after movable spring plate 1 rotates relatively to stationary spring plate 2. An inserting slot 4 is formed between movable spring plate 1 and stationary spring plate 2, and the width of inserting slot 4 is gradually decreased from inner part to outer part. Ending cap 6 blocks reset spring member 3 and is adaptive with socket body 5, and an abdicating groove 8 is arranged on ending cap 6 for providing space in which movable spring plate 1 is capable of rotating. Bending plate is configured extending from stationary spring plate 2, which is capable of fixing stationary spring plate 2 on a spacing slot of socket body 5. Bending plate is provided with holes in which electrical wire is connecting to adaptive conducting wire or conducting rod. Moreover, both upper ends of movable spring plate 1 and stationary spring plate 2 comprise at least one arc-shape bending section 10 to provide many bending surfaces for enlarging contact area with conductive column of plug. The inner side of upper ends can also be rounded so that conductive column can be inserted easily.

Embodiment 2

Figure 2:
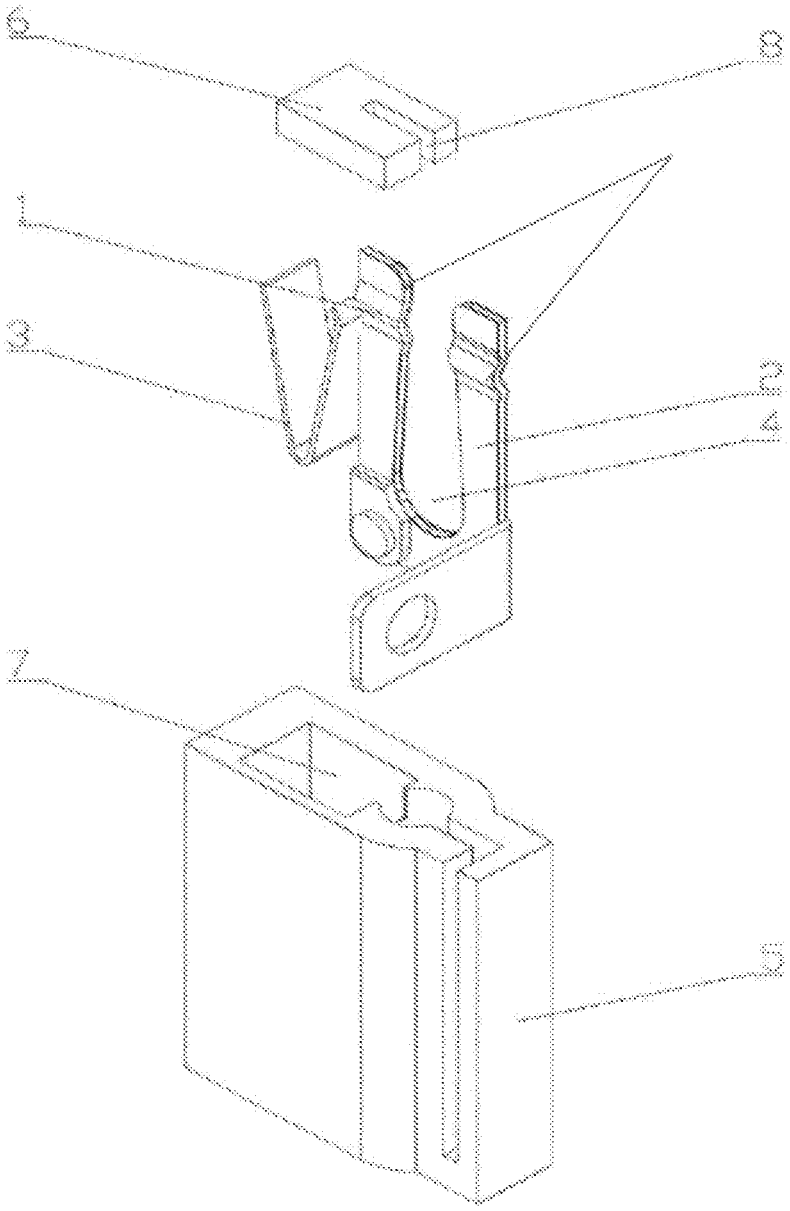
FIG. 2 illustrates a schematic view of the second embodiment of the present invention.

Referring to FIG. 2, the difference between embodiment 1 and embodiment 2 is that reset spring member 3 of this embodiment is a leaf spring which comprises two elastic plates with a tension between each other specifically. Rest spring member 3 is fixed with movable spring plate 1 by welding.

Embodiment 3

Figure 3:
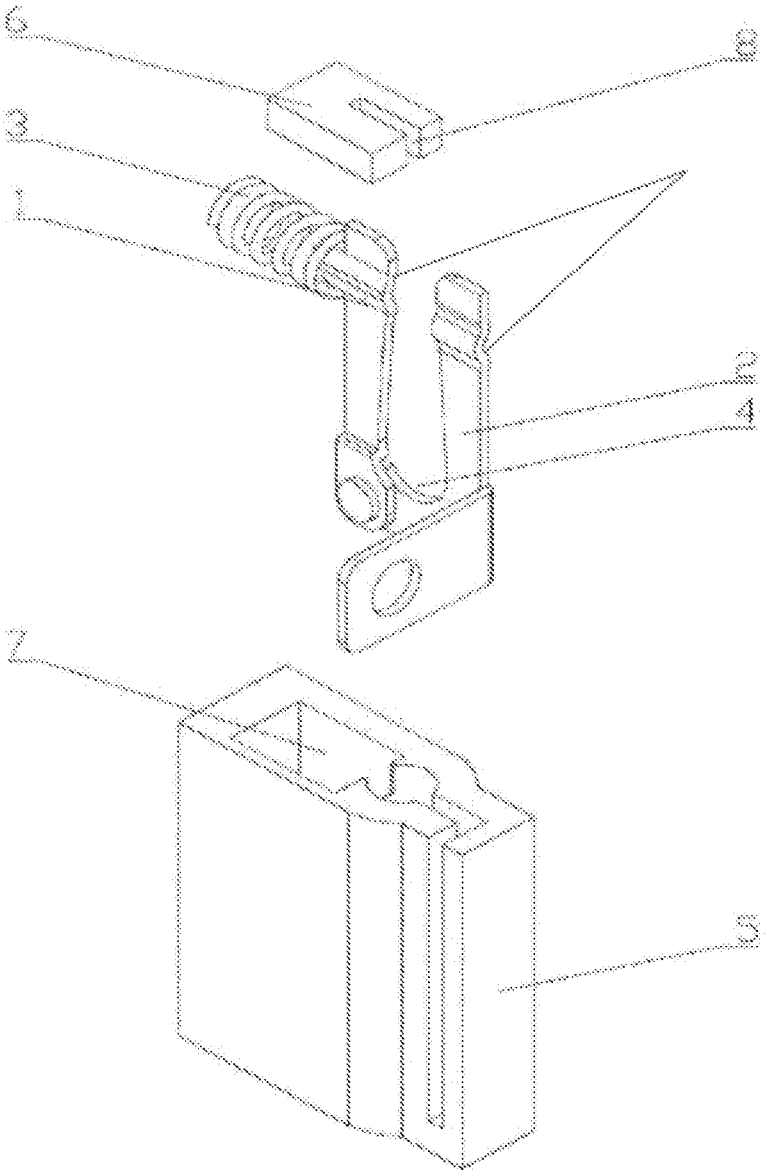
FIG. 3 illustrates a schematic view of the third embodiment of the present invention.

Referring to FIG. 3, the difference between embodiment 1 and embodiment 3 is that reset spring member 3 of this embodiment is a cylinder spring. Positioning rods are configured on movable spring plate 1 and/or socket body 5. The cylinder spring is fixed on positioning rod.

The present invention can be widely used in the field of electrical connection.

I claim:

1. A conducting device comprising:

a movable spring plate, a stationary spring plate and a reset spring member; wherein the movable spring plate is installed on the stationary spring plate and rotatably connected with the stationary spring plate; the reset spring member is located in the outer side of the movable spring plate and contacts with the movable spring plate; an inserting slot is formed between the movable spring plate and the stationary spring plate, and the width of the inserting slot is gradually decreased from inner part to outer part.

2. The conducting device according to claim 1, wherein the reset spring member is a cylinder spring, leaf spring, torsional spring or elastic rubber article, and the reset spring member is provided transversely and located in the outer side of the movable spring plate rotating direction.

3. The conducting device according to claim 1, wherein lower end of the movable spring plate is rotatably connected with lower end of the stationary spring plate, and both upper ends of the movable spring plate and stationary spring plate comprise at least one arc-shape bending section.

4. A socket comprising:

a conducting device, a socket body and an ending cap arranged on the socket body;

wherein the conducting device further comprises a movable spring plate, a stationary spring plate and a reset spring member;

wherein the movable spring plate is installed on the stationary spring plate and rotatably connected with the stationary spring plate; the reset spring member is located in the outer side of the movable spring plate and contacts with the movable spring plate; an inserting slot is formed between the movable spring plate and the stationary spring plate, and the width of the inserting slot is gradually decreased from inner part to outer part;

the conducting device is arranged in an accommodating groove of the socket body;

the ending cap blocks the reset spring member and is adaptive with the socket body, and an abdicating groove is arranged on the ending cap for providing space in which the movable spring plate is capable of rotating.

5. The conducting device according to claim 2, wherein lower end of the movable spring plate is rotatably connected with lower end of the stationary spring plate, and both upper ends of the movable spring plate and stationary spring plate comprise at least one arc-shape bending section.

* * * * *